US005152400A

United States Patent [19]

Lybecker

[11] Patent Number: 5,152,400

[45] Date of Patent: Oct. 6, 1992

[54] SNAP ACTION PARTICLE SEPARATING APPARATUS

[75] Inventor: G. Wayne Lybecker, Rochester, Mich.

[73] Assignee: Engineered Systems, Inc., Fraser, Mich.

[21] Appl. No.: 694,889

[22] Filed: May 2, 1991

[51] Int. Cl.[5] ..... B07B 5/00

[52] U.S. Cl. ..... 209/257; 209/341; 209/343

[58] Field of Search ..... 209/257, 341-343, 209/365.1, 365.3

[56] References Cited

U.S. PATENT DOCUMENTS 142,729 9/1873 Reynolds ..... 209/343

3,971,714 7/1976 Jones et al. ..... 209/257

*Primary Examiner*—Joseph E. Valenza

*Attorney, Agent, or Firm*—Basile and Hanlon

[57] ABSTRACT

Particle separating apparatus includes a horizontally disposed rectangular screen or grid having openings adapted to pass smaller particles from a stream of particles of varying sizes while retaining larger particles upon the top of the screen. A conveying screw mounted in a trough below the screen conveys the smaller particles forwardly along the trough to a discharge opening. The screen is mounted above the screw for horizontal reciprocation along a path parallel to the longitudinal axis of the screw and is biassed by springs engaged between the front and rear ends of the screen and stationary surfaces to a normal rest position midway between the ends of the reciprocating path. A rigid drive member having a flight engaging roller or slide plate at its lower end projects downwardly from the screen into the path of the conveying flight of the screw and is driven forwardly by the screw flight as the screw is rotated until the front end edge of the flight rotates past the drive member to allow the screen to be driven rearwardly in a snap action by the springs engaged with the front end of the screen. The screen subsequently oscillates about its rest position under the action of the springs at the opposite ends of the screen to shake and sift smaller particles from the mass of particles collected at the top of the screen. Various arrangements for minimizing pinching of larger particles between the screw auger flight and the trough wall are disclosed.

12 Claims, 5 Drawing Sheets

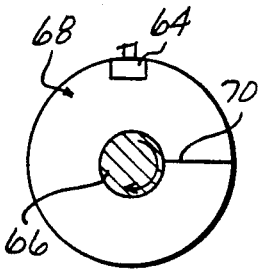
FIG-4A
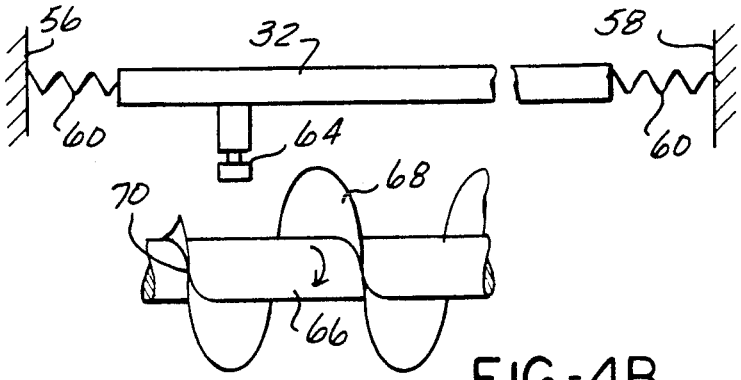
FIG-4B
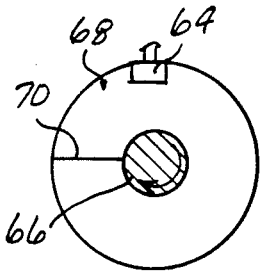
FIG-5A
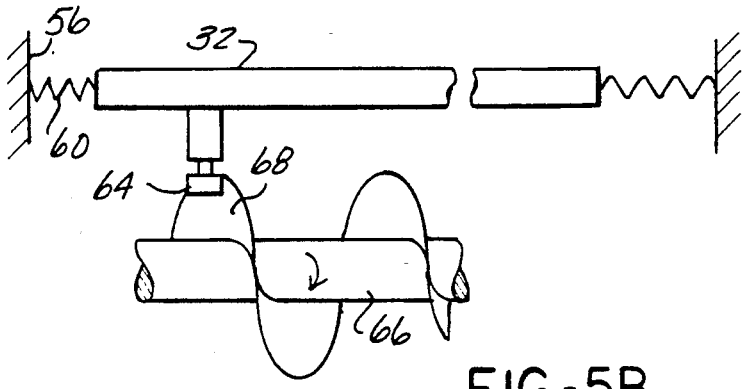
FIG-5B
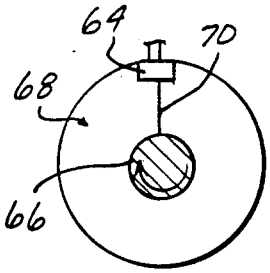
FIG-6A
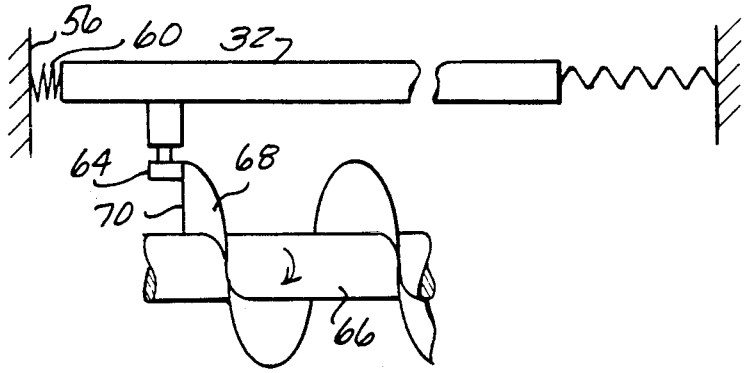
FIG-6B
FIG-7A
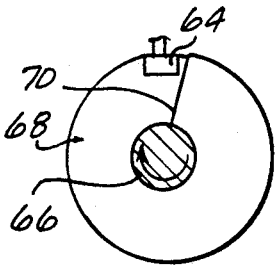
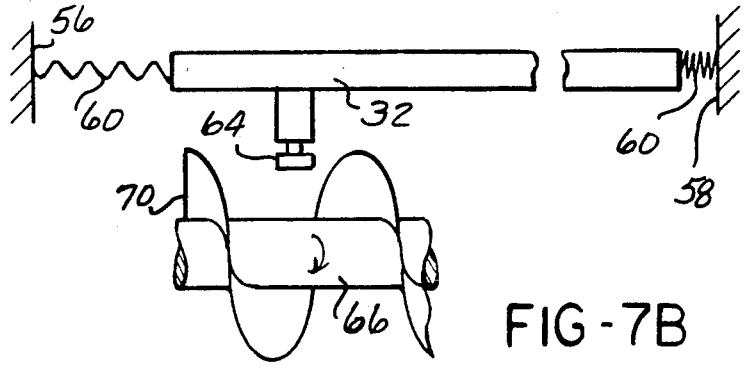
FIG-7B

SNAP ACTION PARTICLE SEPARATING APPARATUS

BACKGROUND OF THE INVENTION

The present invention is directed to a particle separating apparatus which employs a grid or screen deck to separate the larger sized particles from a more or less continuous flow of particles of randomly varying size by directing the flow of particles onto the top of a grid or screen deck which is sized to permit the smaller particles to pass through the perforated grid while retaining the larger particles (overs) on the top of the grid, a process frequently referred to as a scalping (separating) operation.

The present invention is especially well adapted for use in a metal chip processing system employed to reclaim machining metal chips produced by mass production machining operations, such as production lines employed to machine finish parts such as engine blocks, heads, valve bodies, transmission cases, etc. on a mass production basis. Many of these parts today are being made of aluminum or other metals whose intrinsic value is such as to justify a fairly substantial investment in equipment for processing and reclaiming chips generated in the machining operation.

A typical chip processing system finds the metal chips collected at all of the various machine tools being conveyed or transferred to a common collection point representing the inlet end of the chip processing system. In that typically the collected chips are produced by several different types of machining operations, the chip sizes and shapes can vary over a substantial range, and most chips when initially collected will be coated with cutting oils or coolants employed during the machining operation. In addition to the chips themselves, many shop workers view the chip bins or collection receptacles as convenient places to discard metal objects such as broken tools, spoiled/damaged parts, etc., these objects being generally referred to as tramp metal. Chip processing systems typically clean and dry the chips and the processing equipment employed, while designed to handle a wide range of particle sizes, tends to be clogged, jammed or obstructed by the larger particles, particles which may tend to cling to each other in bundles, and tramp metal of the type referred to above. Thus, the initial step of the chip reclamation process is to separate tramp metal, chip bundles and large particles in excess of a selected size to avoid the foregoing problems with downstream processing equipment. Typically, this is accomplished by dumping the particles upon a perforated horizontal vibrating screen deck which allows the smaller particles to pass downwardly through the screen onto a conveying device which feeds the passed particles into the processing chip equipment system. Particles too large to pass through the screen openings are collected on top of the screen as "overs" and periodically manually removed. In some cases the "overs" are passed through a hammer mill or other device which reduces the size of the particle bundles to sizes which may be handled efficiently by the chip processing equipment and/or discarded and recycled by other processing means.

The chips produced by machining operations typically will have sharp jagged "fish hook" edges and thus tend to interlock or cling to other chips to produce chip bundles or hooked necklasses which may be of a size large enough to be retained on the top of the screen, even though the individual chips which make up the bundle are all much smaller than the screen opening. Other chips of relatively small size may fall upon the screen on top of larger chips and be retained against passage through the screen due to blinding. To induce these smaller (selected size) chips to pass through the screen, in some instances the screen is vibrated in an attempt to sift the smaller particles through the screen as by breaking up the hooked chip neckless bundles and shaking smaller particles loose from the bundles. However, large dynamic variations to supporting structures and limits to deck length due to the need to drive the screen deck at the center of gravity are the limiting factors on conventional screens (vibrating type).

In that the smaller particles which pass through the screen drop freely from the underside of the screen, the most convenient way to collect these particles is in a trough underlying the screen, and hence a conveying screw or auger operating in the bottom of the trough is the most common device employed to advance chips which pass through the screen to the next stage of the chip processing system. While conveying augers of this type are efficient and well adapted for this use, where metal particles are involved, the auger has one inherent characteristic which will cause problems. This is the fact that rotation of the auger causes that portion of the conveying flight on one side of a vertical plane containing the auger shaft axis to move upwardly while the portions of the conveying flight on the opposite side of that vertical plane must move downwardly. The trough side walls are inclined downwardly toward opposite sides of the auger to pass beneath the auger with a relatively small operating clearance between the trough and the lower portions peripheral edge of the conveying flight of the auger. On that side of the auger which is moving downwardly, particles are pushed both forwardly and downwardly by the flight into a conveying nip between the edge of the converging flight and the trough wall, this side of the flight being frequently referred to as the "pinch" side of the auger. Where relatively hard metal chips (solids) are involved, the chips/solids can become pinched or jammed between the conveyor auger flight and trough wall. This condition will overload the auger drive equipment motor and stall the screw auger rotation.

The present invention is directed to a scalping grid or screen deck which may be driven in a horizontal vibratory movement induced by the rotating conveying screw auger and in which pinching or jamming of the fixed machine conveyor screw or auger is minimized or eliminated by an integral shelf rigidly attached below the screen/deck.

SUMMARY OF THE INVENTION

In accordance with the present invention a conveying screw auger utilized to advance smaller separated chip particles to a discharge opening is disposed at the bottom of a trough whose open top is covered by a rigid perforated separating screen deck or grid sized to establish an optimum particle size of chip materials which pass through the screen into the trough for processing in the chip system and final recyling to a foundry operation.

The perforated grid deck is mounted above the conveying screw auger for horizontal reciprocatory sifting movement along a path parallel to the longitudinal axis of the conveying auger screw. The conveying screw or auger is of a standard heavy duty type having a longitudinally extending shaft upon which a rigid helical conveying flight is fixedly secured. At the downstream end of the auger, the flight terminates in a radially extending front end edge. A drive member fixedly mounted to the underside of the horizontal separating screen deck frame projects downwardly from the frame in a direction radially of the screw axis into the path of movement of the conveying flight of the auger. Compression springs are engaged between the front and rear ends of the horizontal separating screen deck and fixed surfaces to normally resiliently bias the screen to a rest position in which the drive member on the separating screen would be spaced axially rearwardly of a radial plane containing the front end edge of the screw flight by a distance less than one half of the pitch of the helical flight of the screw. Upon rotation of the auger in the forward direction, the auger flight will, in effect, move axially forwardly to engage the drive member arm and continued rotation of the screw auger flight will drive the screen deck forwardly horizontally, in the same manner that acceptable sized particles in the trough are being conveyed forwardly by the screw auger. Eventually, however, the front end edge of the flight will be rotated past and clear of the drive member arm, at which time the compressed springs engaged between the fixed frame and screen deck will drive the screen rearwardly in a snap action past its normal rest position, and the screen will oscillate forwardly and rearwardly horizontally at natural frequency between the opposed spring system until the motion dies out or its drive member arm is again engaged by the screw flight to again advance the screen deck forwardly with the screw auger flight. The forward movement of the screen by the engagement between its drive member arm and the flight of the rotating screw auger is relatively slow, however, when the front edge of the auger flight clears the arm, the screen is snapped rearwardly with a substantial force (speed). This initial snap action, which is cyclically repeated, tends to convey chips and other material trapped on top of the screen toward the forward end of the screen from which the oversize collected chips/solids are periodically removed for further processing in a high speed turnings crusher or hammer mill and/or disposed of by other process for recyling purposes.

To eliminate the number of larger particles which might fall through the screen on the "pinch" side of the screw conveyor auger, a shelf is rigidly fixed to the underside of the screen deck in spaced relationship below the screen and above the screw to overlie (completely cover) the "pinch" side of the screw auger flights, the shelf terminating at a longitudinal side edge lying substantially in the same vertical plane as the screw auger axis.

In one embodiment, the shelf is horizontal, and plow-like pusher elements may be fixed to the upper surface of the shelf to extend laterally across the top of the shelf at a forty-five degree angle to the longitudinal side edge such that snap action rearward movement of the shelf with the screen deck would tend to kick particles off the shelf onto the pusher side of the auger flight. In another form, the shelf may be inclined downwardly from the underside of the screen toward the pusher side of the auger.

Alternatively the screen openings at the pinch side of the screen may be made smaller than those overlying the pusher side of the auger flight less than the operating clearance between the auger and trough.

Other objects and features of the invention will become apparent by reference to the following specification and to the drawings.

IN THE DRAWINGS

FIGS. 4A and 4B are respectively end and side view schematic diagrams showing one phase of operation of the apparatus of FIGS. 1-3;

FIGS. 5A and 5B are schematic end and side views showing a successive phase of operation of the apparatus;

FIGS. 6A and 6B are schematic end and side views showing a successive phase of operation of the apparatus;

FIGS. 7A and 7B are schematic end and side views showing a successive phase of operation of the apparatus;

Figure 1:
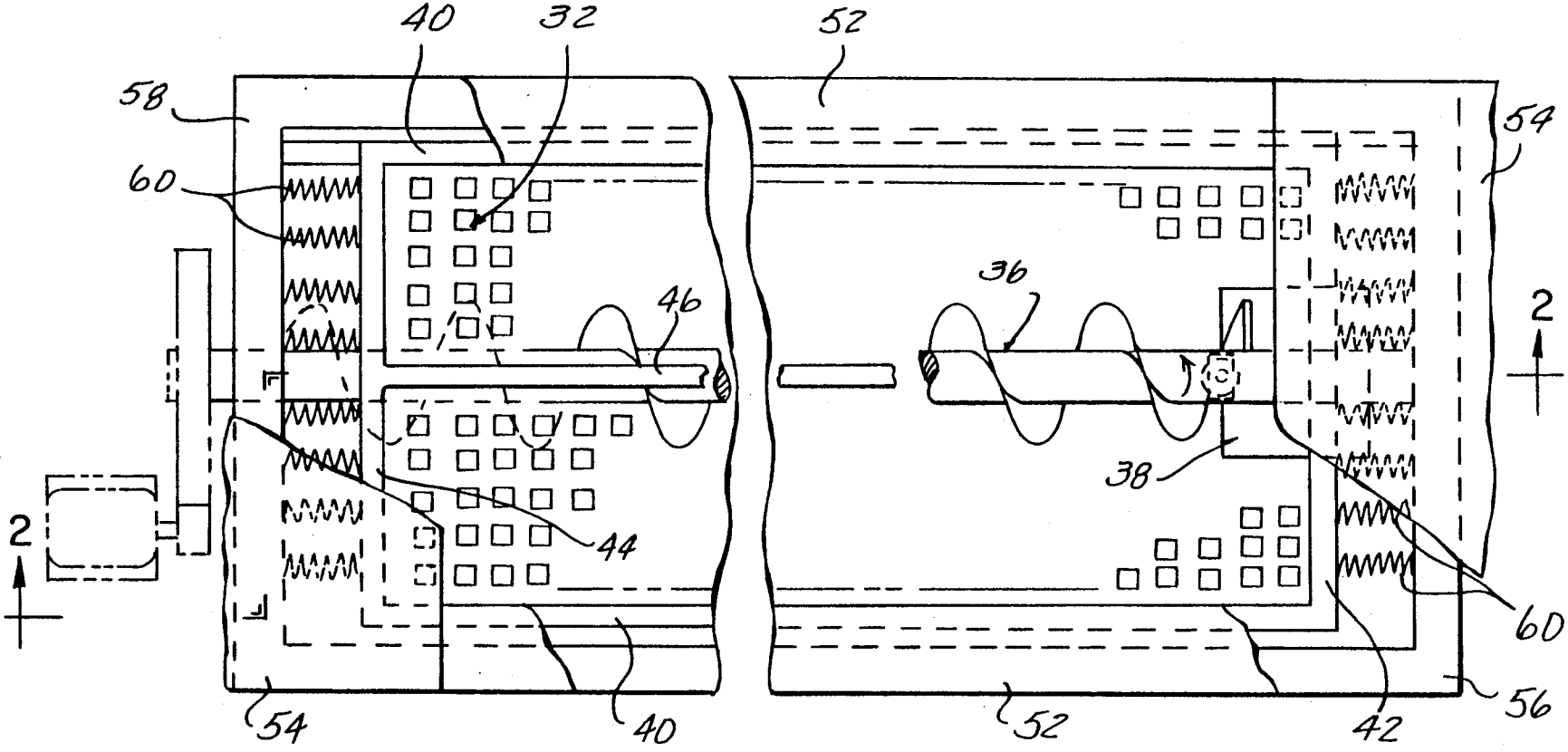
FIG. 1 is a simplified schematic type top plan view of a separating apparatus embodying the present invention with certain parts broken away or shown in section.
Figure 2:
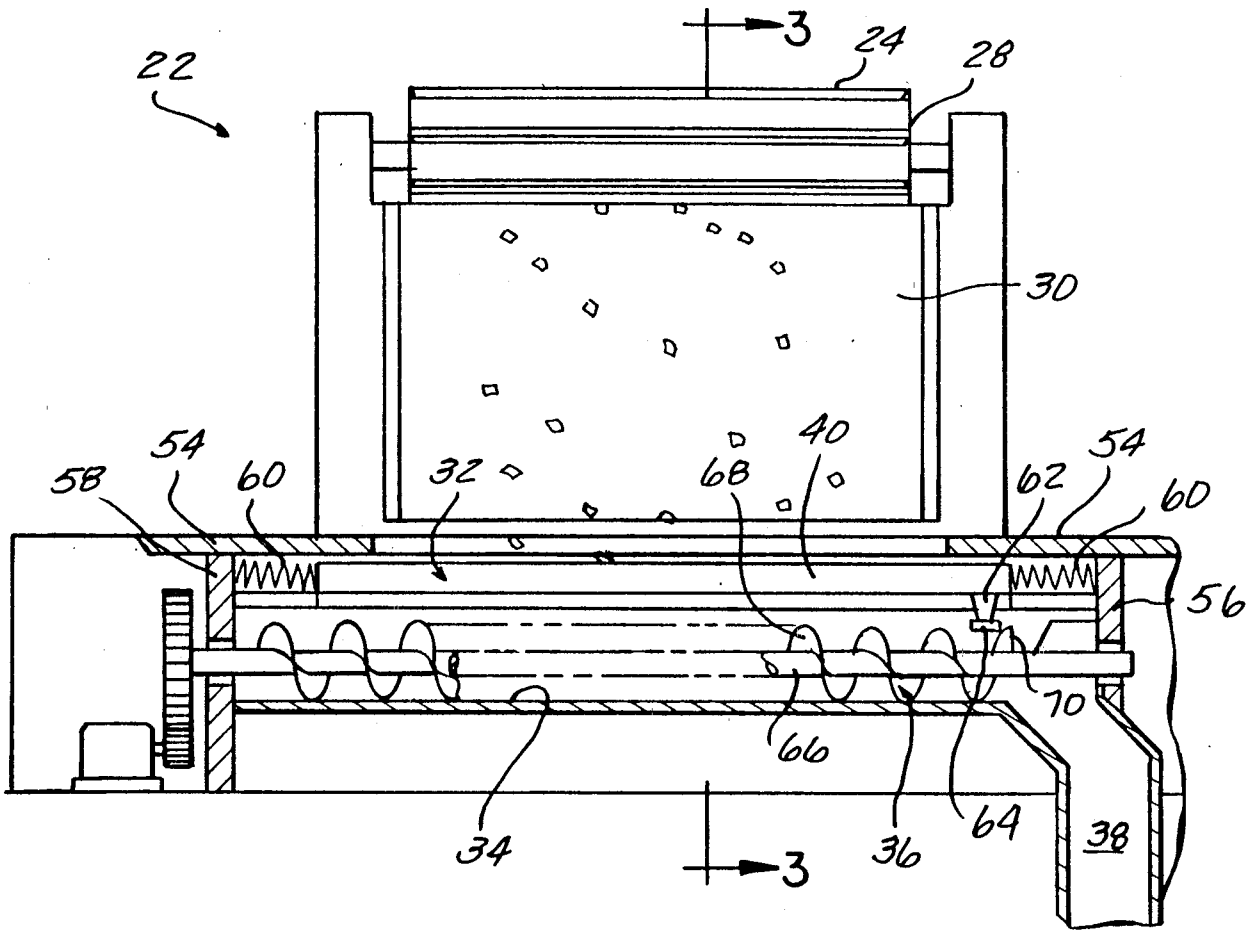
FIG. 2 is a cross sectional view taken on line 2—2 of FIG. 1.
Figure 3:
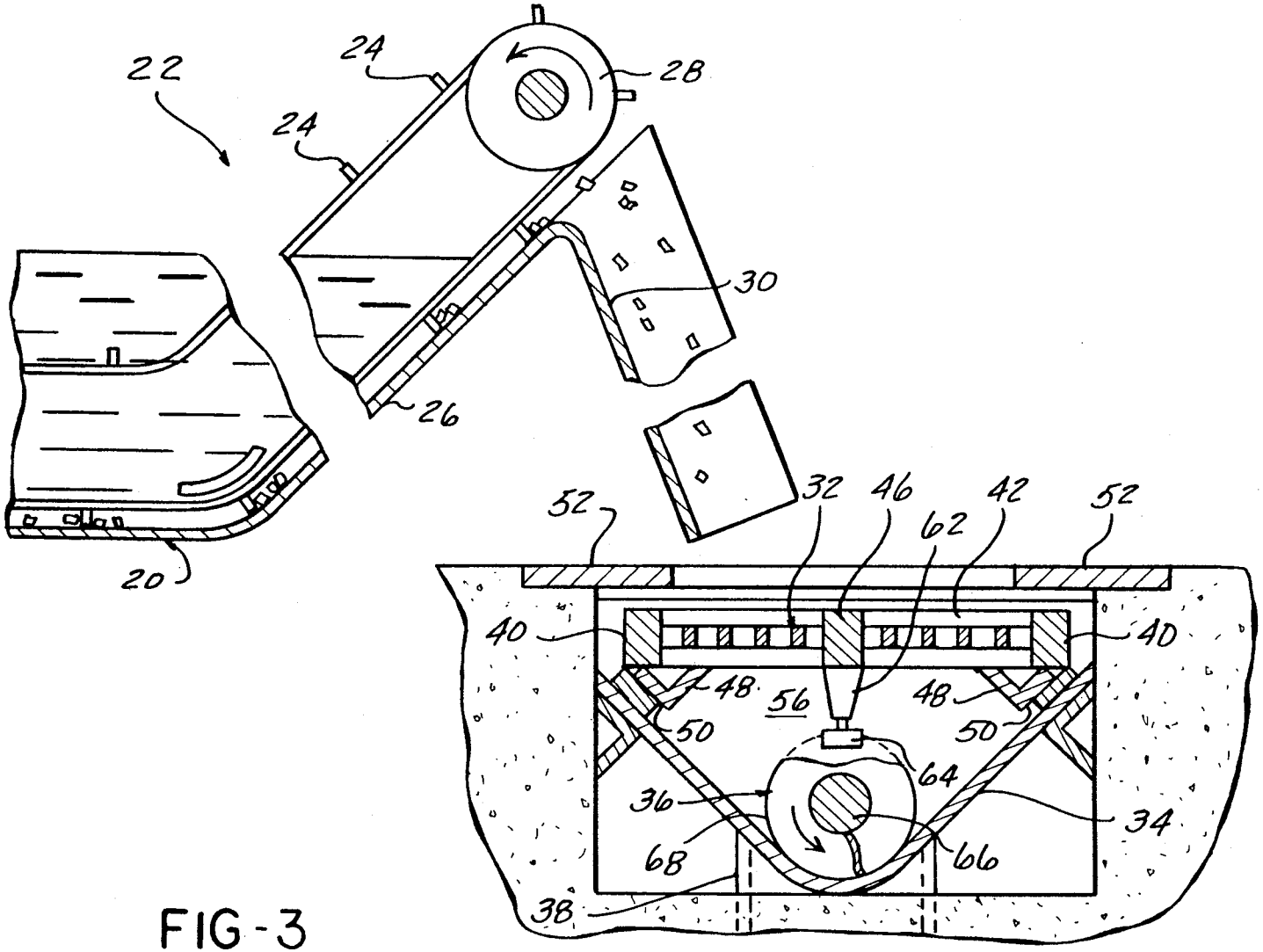
FIG. 3 is a cross sectional view taken approximately upon the line 3—3 of FIG. 2.

The overall environment in which the present invention is employed is best seen in FIGS. 2 and 3, FIG. 3 including a schematic diagram of one end of a settling filter tank designated generally 20 into which particulate material to be separated, such as metal chips resulting from machining of metal articles, is pressed. A drag conveyor including an endless chain or belt 22 having flights in the form of spaced transversely extending bars 24 fixed to one surface is driven in movement in which one run passes across the bottom of the tank, up an inclined ramp 26 forming an end wall of the tank, and over a direction changing end sprocket 28 to be returned back above the tank to its opposite end. Chips or particles separated in the tank settle to the bottom conveying side of the drag conveyor, and the passage of the conveying chain belt 22 across the bottom from left to right as viewed in FIG. 3 causes the flight bars 24 to push settled particles falling below on the chain/scraper flight up the ramp and into the discharge chute 30 which directs the particles onto the top of a rigid horizontal separating screen deck or grid designated generally 32. The screen or grid 32 is formed with perforations or openings of a chosen size so that particles of sizes smaller than the openings in screen 32 can drop through the screen into an underlying trough 34, while particles larger than the screen openings are retained on top of the screen deck 32. Particles which fall through screen deck 32 are advanced by a conveying screw auger 36 along the bottom of trough 34 to a discharge chute 38 located at the right hand end of screw auger 36 as viewed in FIGS. 1 and 2.

Where metal chips produced by machining operation constitute the particles being discharged from the settling filter tank, problems arise due to the fact that the tramp metal solids, parts, and chip bundles tend to cling to or become entangled with each other and, because of this characteristic, may accumulate into bundles which, as a whole, are too large to pass through the openings in screen deck 32, even though many, if not all of the individual particles making up the bundle are smaller than the opening. Further, it is believed apparent that the continued discharge of particles onto screen deck 32 from chute 30 will result in the building up upon the top of screen deck 30 of a thickening layer of chips or chip bundles too large to pass through the screen openings, and that this accumulation will eventually blind the screen unless the collected particles are manually removed or the bundles shaken apart.

In accordance with the present invention, screen 32 is mounted upon or supported at the top of trough 34 for horizontal movement in either direction along a path parallel to the longitudinal axis of conveying auger 36. As best seen in FIG. 1, screen 32 is constructed with an open generally rectangular rigid frame including opposed longitudinal side frame members 40, front 42 and rear 44 end frame members extending between side frame members 40, and a longitudinally extending central frame member 46 which extends between the midpoints of the front and rear end frame members 42, 44. The screen mesh or perforated grid portion fills the spaces between the frame members. As best seen in the cross sectional view of FIG. 3, angle irons 48 which extend the entire length of the screen may be fixedly mounted on the underside of the screen deck at each of the opposite longitudinal edges of the screen to rest upon relatively low friction slide plates 50 fixedly mounted at the top of each side of trough 34. Alternatively, screen 32 may be supported by suitable anti-friction roller-track arrangements. The basic requirement of the mounting is that the screen be stably supported and guided for horizontal movement along a path parallel to the longitudinal axis of conveying screw auger 36. The screen is located by its support at or slightly below floor level. Preferably removable shield plates such as 52, 54 overlie the edges of the screen closely above the top of the screen to minimize the possibility of larger particles from by-passing around the edges of the screen deck and to prevent the screen from jumping from its support during the horizontal vibratory snap action to be described below.

As best seen in FIGS. 1 and 2, the length of trough 34—that is the distance between front and rear end walls 56, 58 substantially exceeds the length of screen 32. Between end walls 56, 58 and the respective front and rear end frame members 42, 44 of the screen, are mounted a plurality of compression springs 60. All of the springs 60 are of the same characteristic and the springs at the front and rear ends of screen 32 act in opposition to each other to resiliently bias the screen deck to what will be referred to as a normal rest position at which the ends of the screen deck are equally spaced from the respective end walls 56, 58.

Referring now particularly to FIGS. 2 and 3, a drive member arm 62 is fixedly secured to the underside of the central frame member 46 of the screen deck near the front or right hand end of the screen deck as viewed in FIG. 2, and projects vertically downwardly from the screen deck in radial alignment with the longitudinal axis of the shaft 66 of conveying screw auger 36. Preferably, drive member arm 62 carries a roller 64 at its lower end rotatable relative to drive arm member 62 about a vertical axis and located, as best seen in FIG. 3, at a distance vertically above the axis of shaft 66 which is slightly less than the outer radius of the auger flight 68 of screw 36. A slide plate may be employed in place of roller 64. As best seen in FIG. 2, flight 68 extends helically of shaft 66 from a front end edge 70. The front edge 70 of screw flight 68 extends radially of the axis of screw 36. When screen deck 32 is in its normal rest position, shown in FIG. 2, the roller 64 (or slide plate) at the lower end of drive member 62 is spaced rearwardly from the radial plane containing edge 70 by a distance which is slightly less than one half of the pitch of screw auger flight 68.

Rotation of screw auger 36 in a direction conveying material along the bottom of trough 34 from left to right as viewed in FIG. 2, will find flight 68 advancing to move into engagement with the rear or left hand side of roller 64 as viewed in FIG. 2. Continued rotation of screw auger 36 will advance the roller 64, drive member 62 and screen deck 32 to the right as viewed in FIG. 2. This action will progressively compress the springs 60 located between the front (right) end of screen deck 32 and end wall 56 as the screw auger continues to rotate. Eventually, the screw auger will rotate to a position such that the radial flight end edge 70 rotates behind and passes beyond roller 64, at which time the roller or slide plate, its drive member and screen deck 32 will be freed and released to "snap-back" very rapidly to the left as viewed in FIG. 2 by the compressed springs 60 between the front end of the screen and front end wall 56. The stored compressive spring force will drive screen deck 32 rapidly to the left beyond the normal rest position shown in FIG. 2, and as the screen deck moves rearwardly past the normal rest position, those springs 60 between the rearward end of screen deck 32 and fixed rear end wall 58 will be compressed to the point where they will drive the screen in a forward stroke. Screen deck 32 will be driven by the opposed springs 60 in horizontal oscillation or natural frequency vibration about its normal rest position until the oscillations die out or the flight of screw 66 again engages the rearward side of roller 64 to begin to drive the roller and screen 32 forwardly.

The interaction between the rotating screw auger and drive member is schematically illustrated in FIGS. 4A–7B. In FIG. 4*a*, which is an end view, screw 36 is in a rotative position such that the front end edge 70 of flight 68 projects horizontally from shaft 66 at the three o'clock position. In FIG. 4B, the situation shown in FIG. 4A is schematically illustrated in side view, with screen 32 being located at its normal rest position by the opposed springs 60 engaged between the front (left in FIG. 4B) end of screen 32 and end wall 56 and between the rear end of screen 32 and rear end wall 58 of the conveyor trough.

In FIGS. 5A and 5B, the screw auger has rotated 180° in a clockwise direction from the FIG. 4A position, and flight 68 has been axially advanced by this rotation to a position such that it has engaged roller or slide plate 64 on screen deck 32 and moved the screen forwardly (to the left) somewhat from the normal rest position shown in FIG. 4B. The springs 60 between the front of screen 32 and the stationary front end wall 56 have been compressed as compared to the position of FIG. 4B, while the springs 60 between the rear end of screen 32 and rear end wall 58 have been somewhat extended.

In FIGS. 6A and 6B, the conveying screw auger has rotated an additional 90° in a clockwise direction from the position of FIGS. 5A and 5B. At this time, as seen in FIG. 6A, the front end edge 70 of the screw auger flight 68 projects upwardly from shaft 66 at the twelve o'-clock position and is directly behind the axis of roller 64. A comparison between FIGS. 6B and 5B shows that in FIG. 6B the screen has been advanced forwardly from the position it assumed in FIG. 5B, and the springs 60 between the front end of screen 32 and the front end wall 56 have been further compressed.

In FIGS. 7A and 7B, the screw has been rotated clockwise from the position of FIGS. 6A and 6B by a slight amount sufficient, as best seen in FIG. 7A, to move front end edge 70 of the screw auger flight clear of roller 64. Once the flight clears the roller or slide plate, the stored compressive force in the springs 60 engaged between the front end of screen 32 and front end wall 56 is released all at once and screen 32 is driven to the left with a snap action by a force sufficient to drive screen 32 to the right as viewed in FIG. 7B well past its normal rest position, compressing the springs 60 between the rear end of screen 32 and rear end wall 58 in the process. The energy stored in the rear springs 60 by this action will in turn drive screen 32 back to the left, compressing the springs in front of the screen so that screen 32 oscillates at natural frequency back and forth about its normal rest position in strokes of decreasing amplitude until the oscillations cease or the flight 68 again engages the screen deck drive roller or slide plate 64 as described above to recommence the natural frequency vibratory cycle.

The sudden release of the compressive force stored in the springs as the screw auger rotates from the FIG. 6A position to the FIG. 7A position is applied to the screen, and the screen thus suddenly moves rapidly rearwardly or snaps back beneath solids/chip bundles supported upon the top of the screen deck so that the screen deck, moves rearwardly relative to a substantial portion of the chips/solids which remain stationary, or substantially so, during the rapid snap-back movement of the screen deck. Thus over an extended period of time and a number of vibratory cycles, oversized chips/solids supported on the top of the screen deck tend to be conveyed forwardly toward one end of the screen deck. Particles of a size small enough to pass through the perforated screen openings are shaken by the horizontal vibratory action of the screen in a sifting action especially during the initial snap back of the screen as the roller slide plate 64 is released from the conveyor screw auger flight. Thus, particles which otherwise would not pass through the screen are enabled to do so, to achieve a more efficient separating, non blinding, non upending, sifting action.

Referring now to FIG. 3, if it is assumed the auger 36 rotates in a counterclockwise direction as viewed in this Figure, then that portion of the auger flight to the right of a vertical plane containing the axis of auger shaft 66 will be moving downwardly as indicated by the curved arrow in FIG. 3. The left-hand side of the wall of trough 34 as viewed in FIG. 3 is inclined downwardly into tangential relationship with the periphery of the screw auger, thus forming a nip of decreasing width between the auger flight periphery and the wall of trough 34. If the size of particles passed by the perforated screen 32 is relatively small as compared to the clearance between the auger and trough bottom, satisfactory conveying action will result. However, where relatively hard metal (particles) solids are involved the larger solids (hard metal) particles can become pinched between the conveyor auger flight and trough wall as the particles move downwardly into the decreasing nip between screw auger and trough wall at the left-hand side of the screw as viewed in FIG. 3. This side of the screw is frequently referred to as the "pinch" side. The pinching problem does not exist at the opposite side of the screw auger in that the screw is moving upwardly and particles are pushed upwardly and forward out of the nip on the right-hand side of the screw auger as opposed to being pushed downwardly and forwardly into the nip at the pinch side of the machine conveyor.

Where the particle sizes and characteristics are such that an undesirable degree of pinching will occur, the screen mesh to the left of the central longitudinal frame member 46 may be made finer than the mesh at the right-hand side of frame member 46 so that the larger particles which pass through the screen will fall onto the "push" side of the auger flight, while the finer screen mesh at the left-hand side of the screen as viewed in FIG. 3 will prevent particles large enough to present pinching problems from passing through the screen.

Figure 8:
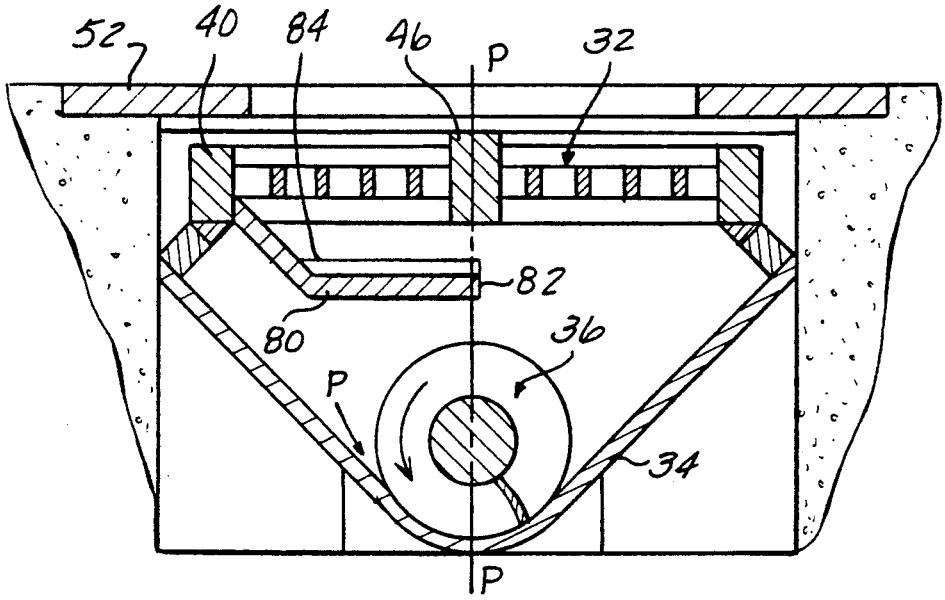
FIG. 8 is a cross sectional view, similar to FIG. 3, showing an improved form of screen assembly.
Figure 10:
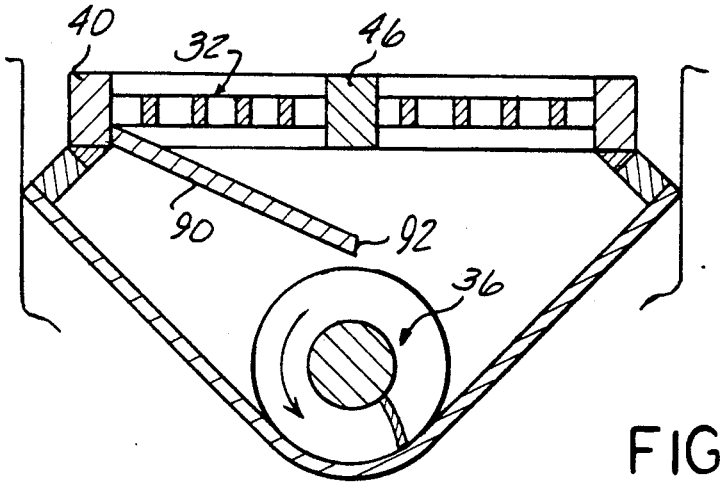
FIG. 10 is a cross sectional view, similar to FIG. 3 showing an alternative form of improved screen assembly.

Alternative arrangements for overcoming the pinching problem are shown in FIGS. 8 and 10.

Figure 9:
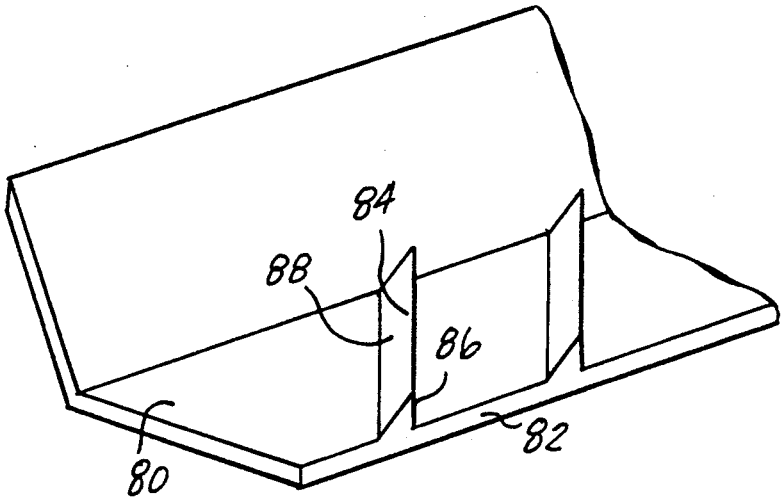
FIG. 9 is a perspective view of a portion of the screen assembly of FIG. 8.

In FIG. 8, a horizontal shelf 80 is fixedly mounted on the underside of screen 32. Shelf 80 extends the entire length of screen 32 and underlies the left-hand half of the screen grid as viewed in FIG. 8, shelf 80 being vertically spaced below the screen and spaced above auger 36. The longitudinal side edge 82 of shelf 80 is located substantially in a vertical plane PP which passes through the axis of auger 36. At the top of the horizontal portion of shelf 80 a plurality of plow-like ribs **84*a*, 84*b* as shown in FIG. 9 are fixedly secured, as by welding, to the shelf. The ribs are inclined at approximately $+-45°$ from the longitudinal side edge 82 of the shelf in a direction such that forward movement of the shelf (generally to the right as viewed in FIG. 9) would cause the vertical forward sides of ribs 84*a* to urge particles in front of them toward the side edge 82. The vertical rearward sides of ribs 84*b* similarly ruge particles toward and over edge 82 upon rearward movement of the shelf. Preferably, the ribs are of a wedge-shaped cross section with a substantially vertical face 86*a*, 86*b* which would push particles toward edge 82 with the other face 88*a* or 88*b* inclined at a relatively low angle, such as 30° or so, so that particularly upon the snap back movement of the screen and shelf described above, particles could move up the 30° incline 88*a* from the rearward side of ribs 84*a*** to the forward side.

In an alternative arrangement of shelf shown in FIG. 10, a shelf 90 is fixedly secured to the left-hand longitudinal side frame member 40 of the screen and is inclined downwardly from frame member 40 to a longitudinal side edge located, as in the previous case, either within or slightly to the right of the plane P—P of the auger axis. While both arrangements (those of FIG. 8 and 10) effectively feed particles only to the push side (right-hand side as viewed in FIGS. 8 and 10) of screw auger 36, the ½ bottom (pushing side) of the trough will eventually be filled with chips, the chips flowing somewhat as a liquid once in the trough by the conveying action of the screw auger rotation. The larger chips/solids will remain on the "push" side of the screw auger, thereby eliminating the pinching problem of a screw auger conveying/handling large particle size materials which would jam the machine.

While various embodiments of the invention have been described in detail, it will be apparent to those skilled in the art the disclosed embodiments may be modified. Therefore, the foregoing description is to be considered exemplary rather than limiting, and the true scope of the invention is that defined in the following claims.

I claim:

1. Separating apparatus for separating separating particles which exceed a selected size from a stream of particles of varying sizes, said apparatus comprising a horizontally disposed generally rectangular rigid perforated grid located to receive said stream of particles upon its top surface to retain particles which exceed said selected size upon the top of said grid while accommodating the passage of particles of a size less than said selected size downwardly through said grid, means defining an elongate trough mounted beneath said grid to receive particles passing through said grid, a conveying screw auger in said trough and including an elongate shaft extending the entire length said trough and mounted for rotation about a horizontal longitudinal axis, and a helical conveying flight auger fixed to said shaft having a pitch P and an outer radius R, first drive means for driving said auger in rotation about said axis in a first direction to cause said flight to advance particles in said trough forwardly along said trough to a discharge opening adjacent the forward end of said trough, said flight terminating at a forward end edge adjacent said forward end of said trough extending radially outwardly from said shaft, guide means mounting said grid for horizontal reciprocatory movement relative said trough along a path parallel to said axis, spring means engaged with said grid for resiliently biassing said grid to a normal rest position at the midpoint of said path, second drive means including a rigid drive member fixed to said grid about said shaft and projecting downwardly from said grid to a lower end spaced from said axis of said shaft by a distance less than R, said lower end of said drive member being axially spaced rearwardly of said forward end edge of said flight by a distance equal to or less than P/2 when said grid is in said normal rest position.

2. The invention defined in claim 1 further comprising a roller mounted at said lower end of said drive member for rotation relative to said drive member about a vertical axis, said roller being tangentially engageable with the forward side of said flight adjacent the radially outer edge of said flight.

3. The invention defined in claim 1 wherein said spring means comprises a stationary member mounted in spaced parallel relationship to each of the opposite ends of said grid, and a plurality of coil springs engaged between each of said stationary members and the adjacent end of said grid to drive said grid in reciprocatory movement along said path.

4. The invention defined in claim 1 wherein said flight is operable upon rotation of said shaft in said first direction to engage said drive member to drive said grid forwardly from said rest position against the action of said spring means until said forward end edge of said flight is rotated past said drive member to disengage said drive member from said flight to allow said grid to be driven rearwardly past said rest position and oscillated about said rest position by said spring means.

5. The invention defined in claim 1 wherein said means mounting said grid for horizontal reciprocating movement comprises upwardly and outwardly inclined side wall portions extending the entire length of said trough along opposite sides thereof, and support means at each of the opposite longitudinal sides of said grid resting upon said side wall portions of said trough to support said grid above said auger.

6. The invention defined in claim 1 wherein said grid comprises a pair of longitudinally extending spaced parallel side frame members, a pair of transversely extending spaced parallel end frame members fixedly interconnecting said side frame members, a central longitudinal frame member fixedly secured to and extending between said end frame members midway between said side frame members, open mesh grid work mounted upon and extending between said frame members said guide means comprising means extending along the opposite sides of said trough engaged with means on the respective side frame members to support said grid upon said trough for guided movement along said path, said drive member including a port fixedly mounted on and projecting downwardly from said central frame member.

7. The invention defined in claim 6 further comprising a pair of stationary end wall adjacent opposite ends of said trough, said spring means comprising a plurality of like coil springs engaged between the respective end frame members of said grid and said end walls.

8. The invention defined in claim 1 wherein the longitudinal center line of said grid and the axis of rotation of said auger lie in a common vertical plane with that portion of said auger at one side of said vertical plane moving downwardly about said axis upon rotation of said auger in said first direction, and means restricting the flow of larger particles through said grid to that portion of said auger at said one side of said vertical plane.

9. The invention defined in claim 8 wherein said means restricting comprises a first grid portion constituting that portion of said grid at said one side of said vertical plane and a second grid portion constituting that portion of said grid at the opposite side of said vertical plane, both of said grid portions having particle passing openings therethrough, the openings through said first grid portion being smaller than the openings through said second grid portion.

10. The invention defined in claim 8 wherein said means restricting comprises shelf means fixedly mounted on the underside of said grid beneath that portion of said grid at said one side of said vertical plane for deflecting particles passing through said that portion of said grid laterally to the opposite side of said general plane.

11. The invention defined in claim 10 wherein said shelf means comprises a horizontal shelf having ribs fixed to the upper side thereof for deflecting particles on said shelf toward said vertical plane upon horizontal movement of said grid along said path.

12. The invention defined in claim 10 wherein said shelf means comprises a shelf inclined downwardly from the side edge of said grid at said one side of said vertical plane toward and at least to said vertical plane whereby all particles passing through said grid initially fall into said trough at the side of said general plane opposite said one side.

* * * * *